US010221603B2

(12) United States Patent
Graham

(10) Patent No.: US 10,221,603 B2
(45) Date of Patent: Mar. 5, 2019

(54) COUNTERBALANCE AND METHOD OF MAKING THE SAME

(71) Applicant: Weber Knapp Company, Jamestown, NY (US)

(72) Inventor: Daniel M. Graham, Ashville, NY (US)

(73) Assignee: Weber Knapp Company, Jamestown, NY (US)

( * ) Notice: Subject to any disclaimer, the term of this patent is extended or adjusted under 35 U.S.C. 154(b) by 1 day.

(21) Appl. No.: 15/486,884

(22) Filed: Apr. 13, 2017

(65) Prior Publication Data

US 2018/0298662 A1 Oct. 18, 2018

(51) Int. Cl.
*E05F 1/08* (2006.01)
*E05F 1/12* (2006.01)
(Continued)

(52) U.S. Cl.
CPC ..... *E05F 1/1261* (2013.01); *E05D 3/12* (2013.01); *E05D 11/0054* (2013.01); *E05F 1/1058* (2013.01); *E05Y 2900/602* (2013.01)

(58) Field of Classification Search
CPC ..... Y10T 16/5383; Y10T 16/53834; Y10T 16/53835; Y10T 16/53885;
(Continued)

(56) References Cited

U.S. PATENT DOCUMENTS 2,777,157 A * 1/1957 Burke ..... E05F 1/1261 16/290
2,911,667 A * 11/1959 Burke ..... E05F 1/1261 16/290

(Continued)

OTHER PUBLICATIONS http://www.shopperschoice.com/item_item_2854886.html; undated, last accessed Jun. 7, 2016.

(Continued)

*Primary Examiner* — Chuck Y Mah
(74) *Attorney, Agent, or Firm* — Simpson & Simpson, PLLC

(57) ABSTRACT

A counterbalance assembly including a housing, a pivot nose, and a spring pack. The housing including a front housing wall having a first housing edge and a second housing edge opposite the first housing edge, a first housing side wall projecting from the first housing edge and having a first retaining slot, and a second housing side wall oppositely disposed relative to the first housing side wall, projecting from the second housing edge and having second retaining slot in registered alignment with the first retaining slot. The pivot nose including a front pivot nose wall having a first pivot nose edge and a second pivot nose edge opposite the first pivot nose edge, a first pivot nose side wall projecting from the first pivot nose edge and having a first pivot nose through hole, and a second pivot nose side wall oppositely disposed relative to the first pivot nose side wall, projecting from the second pivot nose edge and having a second pivot nose through hole, the first and second pivot nose through holes are in registered alignment with the first and second retaining slot. The spring pack disposed within a volume formed by the housing and including a first end engaged with the housing, a second end engaged with the pivot nose, and an energy storage device arranged between the first and second ends.

20 Claims, 11 Drawing Sheets

(51) Int. Cl.
*E05D 3/12* (2006.01)
*E05D 11/00* (2006.01)
*E05F 1/10* (2006.01)

(58) Field of Classification Search
CPC ..... Y10T 16/53888; Y10T 16/5389; B65D 43/24; B65D 43/16; B65D 43/163; B65D 43/167; E05F 1/1261; E05F 1/1246; E05F 1/1253; E05F 1/1269; E05F 1/1276; E05F 1/1292; E05F 3/18; E05F 3/20; E05F 1/1041; E05F 1/105; E05F 1/1058; E05F 1/1066; E05F 1/1075; E05F 1/1091; E05D 3/12; E05Y 2900/602
See application file for complete search history.

(56) References Cited

U.S. PATENT DOCUMENTS 3,001,225 A * 9/1961 Squire ..... E05D 1/04 16/287
3,187,374 A * 6/1965 Lundell ..... A45C 13/34 16/289
3,224,036 A * 12/1965 Himes ..... E05F 1/1261 16/289
3,256,554 A * 6/1966 Turner ..... E05F 1/1261 16/273
3,457,584 A * 7/1969 Phelps ..... E05F 1/1261 16/290
3,771,194 A * 11/1973 Little ..... E05F 1/1261 16/289
4,365,385 A * 12/1982 Gotoh ..... E05D 5/0246 16/382
4,520,977 A * 6/1985 Holzhauser ..... G03B 27/6207 16/306
5,003,347 A * 3/1991 Kameda ..... G03B 27/6228 355/25
5,541,712 A * 7/1996 Fujitaka ..... G03B 27/6228 355/75
5,621,501 A * 4/1997 Matsuo ..... G03G 15/605 355/75
6,021,606 A * 2/2000 Kos ..... E02D 29/124 16/289
8,235,882 B2 * 8/2012 Reiff ..... B04B 7/02 49/386
9,131,825 B2 * 9/2015 Tameishi ..... A47L 15/0081
2005/0044664 A1 * 3/2005 Chang ..... H04N 1/00543 16/327
2012/0192382 A1 * 8/2012 Honsberger ..... E05F 1/1075 16/401

OTHER PUBLICATIONS

Viking Installation Guide, Viking Range Corporation, Greenwood, MI; C4 Outdoor Cooker Cart Assembly, created Apr. 23, 2008.
U.S. Design Patent Application No. 29/563,068, filed May 2, 2016 and titled Counterbalance (unpublished).
U.S. Design Patent Application No. 29/573,029, filed Aug. 2, 2016 and titled Counterbalance (unpublished).

* cited by examiner

COUNTERBALANCE AND METHOD OF MAKING THE SAME

FIELD OF THE INVENTION

The invention broadly relates to counterbalances, more specifically to a counterbalance for a lid or a top, and even more particularly to a counterbalance for a lid or a top having concealed motion limiters and simplified means of assembly.

BACKGROUND OF THE INVENTION

Counterbalance assemblies are used for a variety of means known in the art. A common example includes counterbalances used to assist with opening and closing large and/or heavy covers, e.g., a ceramic smoker top which could be as heavy as seventy pounds or more. Such counterbalance assemblies are designed to provide a greater torque, which in turn provides a greater lifting force, during the initial opening of the counterbalance or cover, and the magnitude of torque decreases as the counterbalance opens further as less force is needed to assist with opening the cover. The reverse effect occurs upon closing the cover thereby minimizing the likelihood of impacting the cover on the body of the device.

Counterbalances of these types are difficult to assemble and/or install on a device, e.g., a ceramic smoker. Large spring forces must be loaded and contained throughout the assembly, or alternatively, the attachment of the counterbalance to the device may require special tooling, e.g., tooling to hold the cover in an open position during attachment. The foregoing has resulted in counterbalance assemblies with complex mechanical systems used to contain the spring forces.

Moreover, large, heavy pivoting or rotating assemblies can create safety concerns for some users. For example, exposed moving components in a counterbalance assembly can create dangerous pinch points. One such component can include a limiter to rotation of the counterbalance. Typically, rotation limiters rely on contact between two components to restrict rotation beyond a particular amount, and those components are at times easily accessible. An unsuspecting user can readily pinch a finger or article of clothing between moving components thereby creating an unsafe arrangement for a counterbalance.

As can be derived from the variety of devices and methods directed at providing counterbalance assemblies, many means have been contemplated to accomplish the desired end, i.e., easy to assemble and safe to use counterbalance structures. Heretofore, tradeoffs between cost, ease of assembly and safety were required. Thus, there is a long-felt need for a counterbalance that provides significant torque that requires reduced complexity for assembly and is safe to use.

BRIEF SUMMARY OF THE INVENTION

The present invention broadly comprises a counterbalance assembly including a housing, a pivot nose, and a spring pack. The housing including a front housing wall having a first housing edge and a second housing edge opposite the first housing edge, a first housing side wall projecting from the first housing edge and having a first retaining slot, and a second housing side wall oppositely disposed relative to the first housing side wall, projecting from the second housing edge and having second retaining slot in registered alignment with the first retaining slot. The pivot nose including a front pivot nose wall having a first pivot nose edge and a second pivot nose edge opposite the first pivot nose edge, a first pivot nose side wall projecting from the first pivot nose edge and having a first pivot nose through hole, and a second pivot nose side wall oppositely disposed relative to the first pivot nose side wall, projecting from the second pivot nose edge and having a second pivot nose through hole, the first and second pivot nose through holes are in registered alignment with the first and second retaining slot. The spring pack disposed within a volume formed by the housing and including a first end engaged with the housing, a second end engaged with the pivot nose, and an energy storage device arranged between the first and second ends.

Furthermore the present invention broadly comprises a method of assembling a counterbalance including a housing, a pivot nose, a pivot pin and a spring pack. The housing includes a front housing wall having a first housing edge and a second housing edge opposite the first housing edge, a first housing side wall projecting from the first housing edge and having a first retaining slot, and a second housing side wall oppositely disposed relative to the first housing side wall, projecting from the second housing edge and having second retaining slot in registered alignment with the first retaining slot, each of the first and second retaining slots comprises a first portion having a first width and a second portion having a second width smaller than the first width. The pivot nose includes a front pivot nose wall having a first pivot nose edge and a second pivot nose edge opposite the first pivot nose edge, a first pivot nose side wall projecting from the first pivot nose edge and having a first pivot through hole, and a second pivot nose side wall oppositely disposed relative to the first pivot nose side wall, projecting from the second pivot nose edge and having a second pivot nose through hole, the first and second pivot nose through holes are in registered alignment. The spring pack includes a first end engaged with the housing, a second end engaged with the pivot nose, and an energy storage device arranged between the first and second ends. The method includes: aligning the first and second pivot through holes with the first portions of the first and second retaining slots, respectively; positioning the pivot pin within the first and second pivot through holes with the first portions of the first and second retaining slots; and, shifting the pivot pin from the first portions of the first and second retaining slots to the second portions of the first and second retaining slots.

Moreover, the present invention broadly comprises a method of assembling a counterbalance including a housing, a first housing mounting plate, a second housing mounting plate, a pivot nose, a pivot pin, a limit pin and a spring pack. The housing includes a front housing wall having a first housing edge and a second housing edge opposite the first housing edge, a first housing side wall projecting from the first housing edge and having a first retaining slot, and a second housing side wall oppositely disposed relative to the first housing side wall, projecting from the second housing edge and having a second retaining slot in registered alignment with the first retaining slot, each of the first and second retaining slots comprises a first portion having a first width and a second portion having a second width smaller than the first width. The first housing mounting plate includes a first mounting tab, a first arcuate slot and a first mounting plate through hole. The second housing mounting plate includes a second mounting tab, a second arcuate slot and a second mounting plate through hole, each of the first and second pivot nose side walls includes a limit through hole. The pivot nose includes a front pivot nose wall having a first pivot nose edge and a second pivot nose edge opposite the first pivot nose edge, a first pivot nose side wall projecting from the first pivot nose edge and having a first pivot through hole and a limit pin through hole, and a second pivot nose side wall oppositely disposed relative to the first pivot nose side wall, projecting from the second pivot nose edge and having a second pivot nose through hole, and the first and second pivot nose through holes are in registered alignment. The spring pack includes a first end engaged with the housing, a second end engaged with the pivot nose, and an energy storage device arranged between the first and second ends. The method includes: aligning the second end of the spring pack with the through holes in the first and second pivot nose side walls and first and second arcuate slots; and, positioning the limit pin within the second end of the spring pack, the limit through holes in the first and second pivot nose side walls and the first and second arcuate slots.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Although any methods, devices or materials similar or equivalent to those described herein can be used in the practice or testing of the invention, the preferred methods, devices, and materials are now described.

Figure 1:
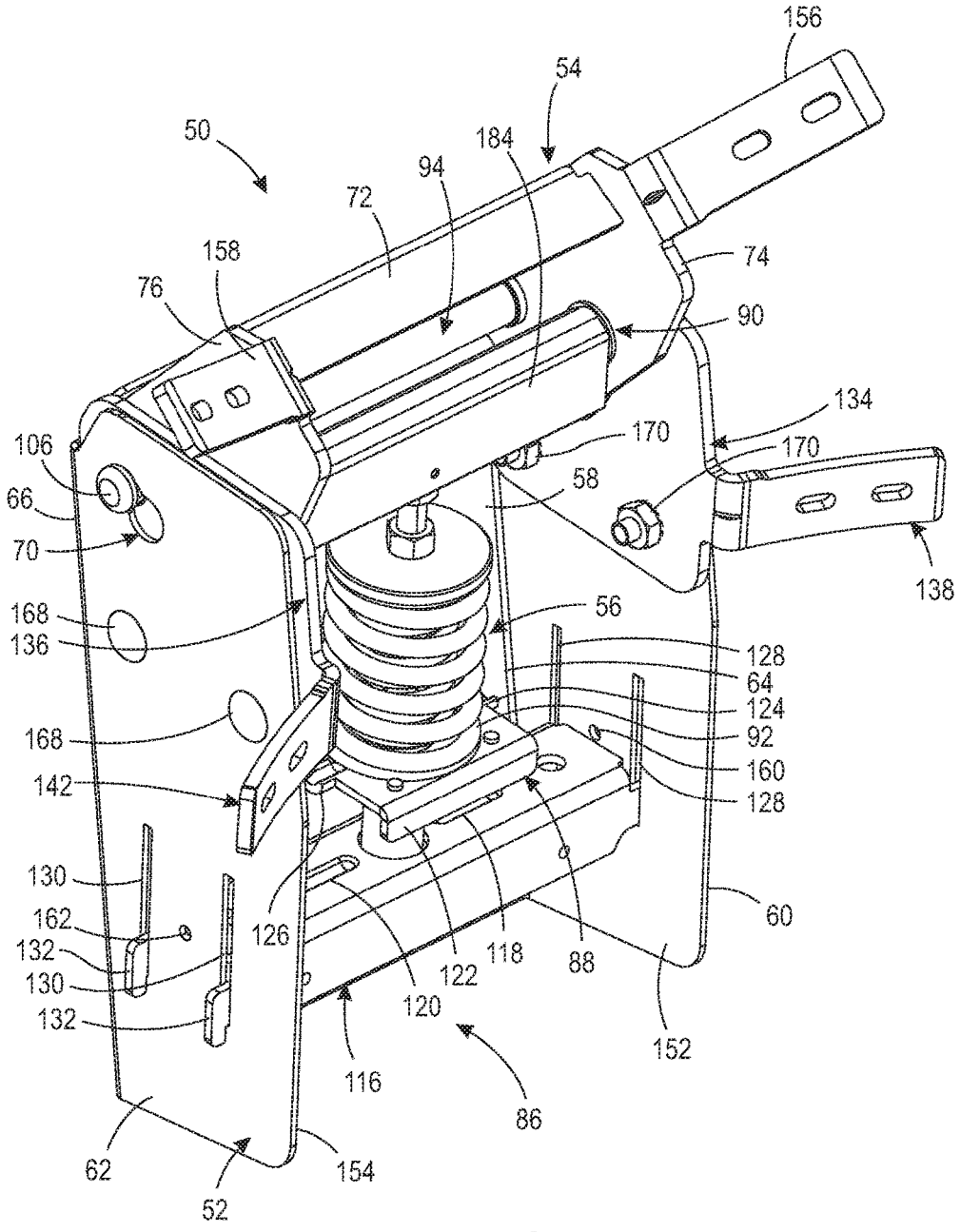
FIG. 1 is a top back perspective view of an embodiment of a present counterbalance assembly.
Figure 2:
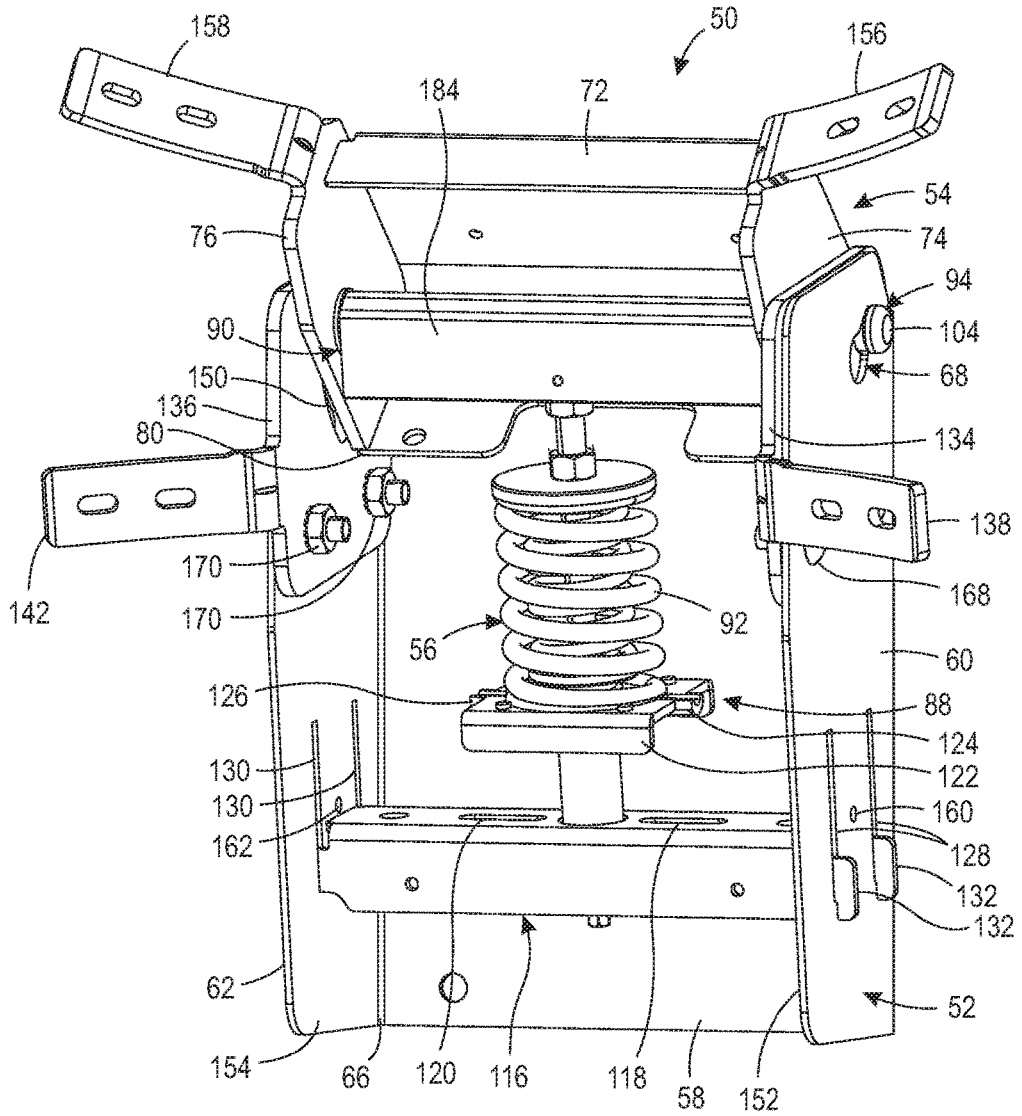
FIG. 2 is a back perspective view of an embodiment of a present counterbalance assembly.
Figure 3:
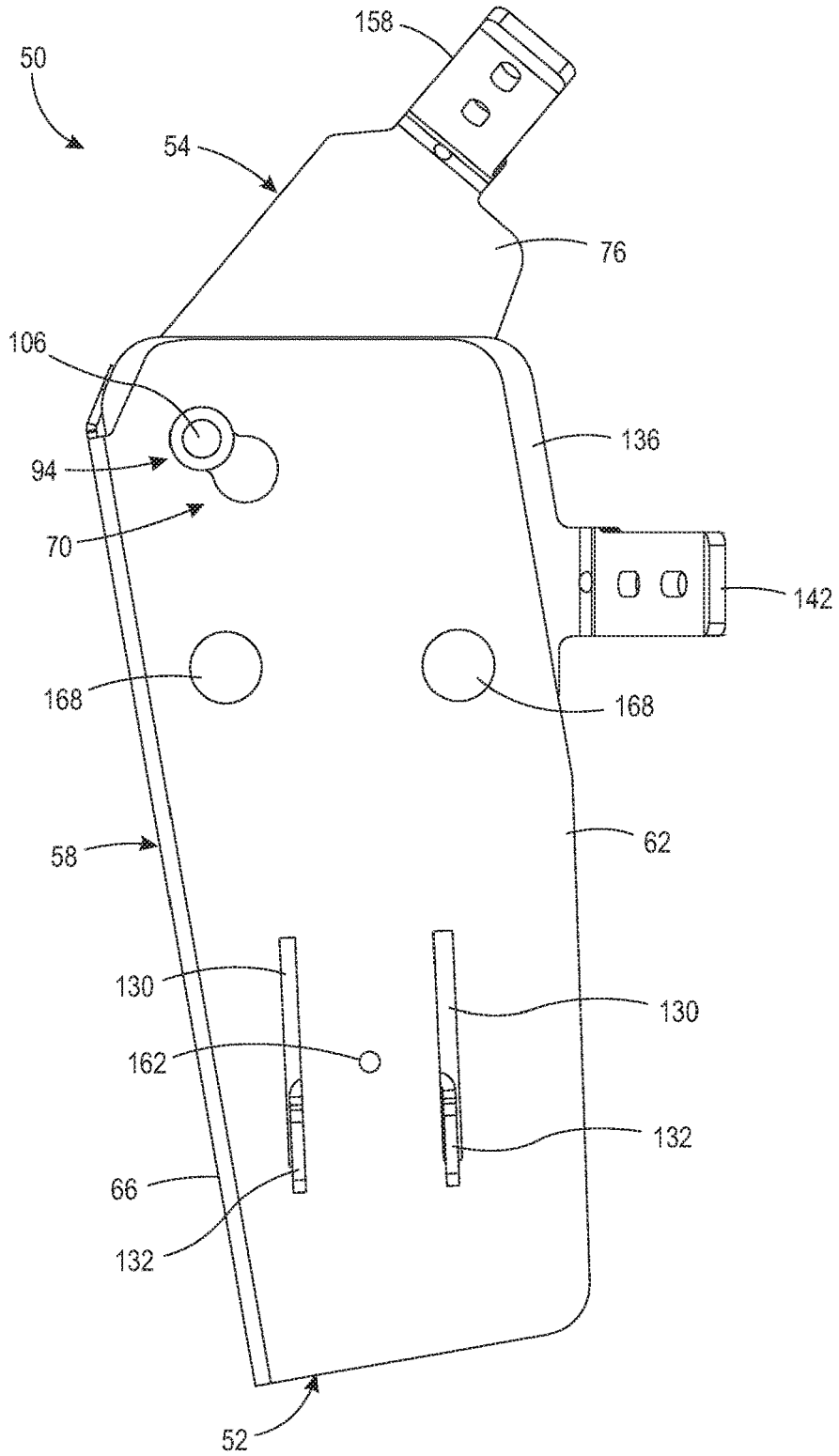
FIG. 3 is a right side elevational view of an embodiment of a present counterbalance assembly.
Figure 4:
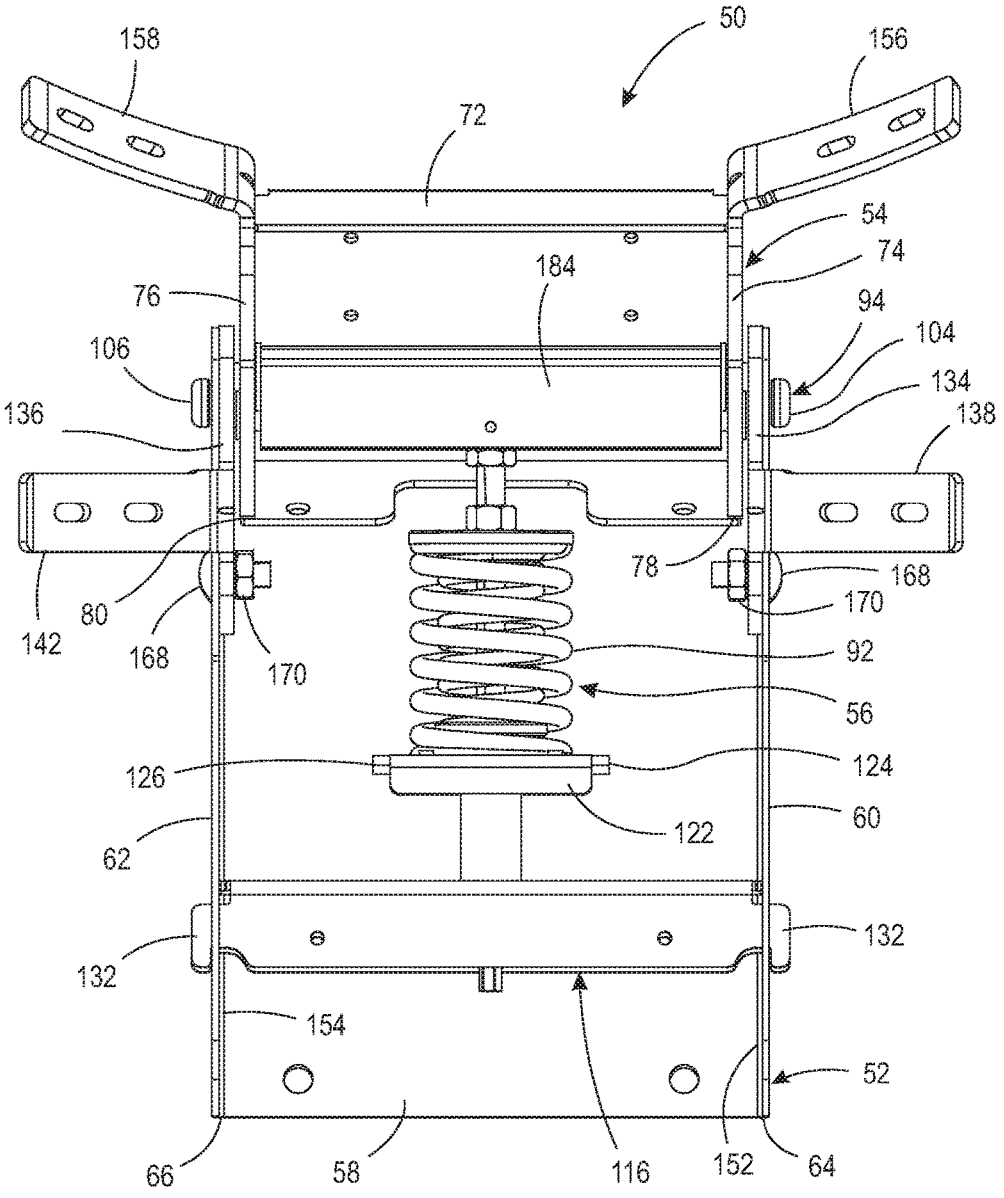
FIG. 4 is a back elevational view of an embodiment of a present counterbalance assembly.
Figure 5:
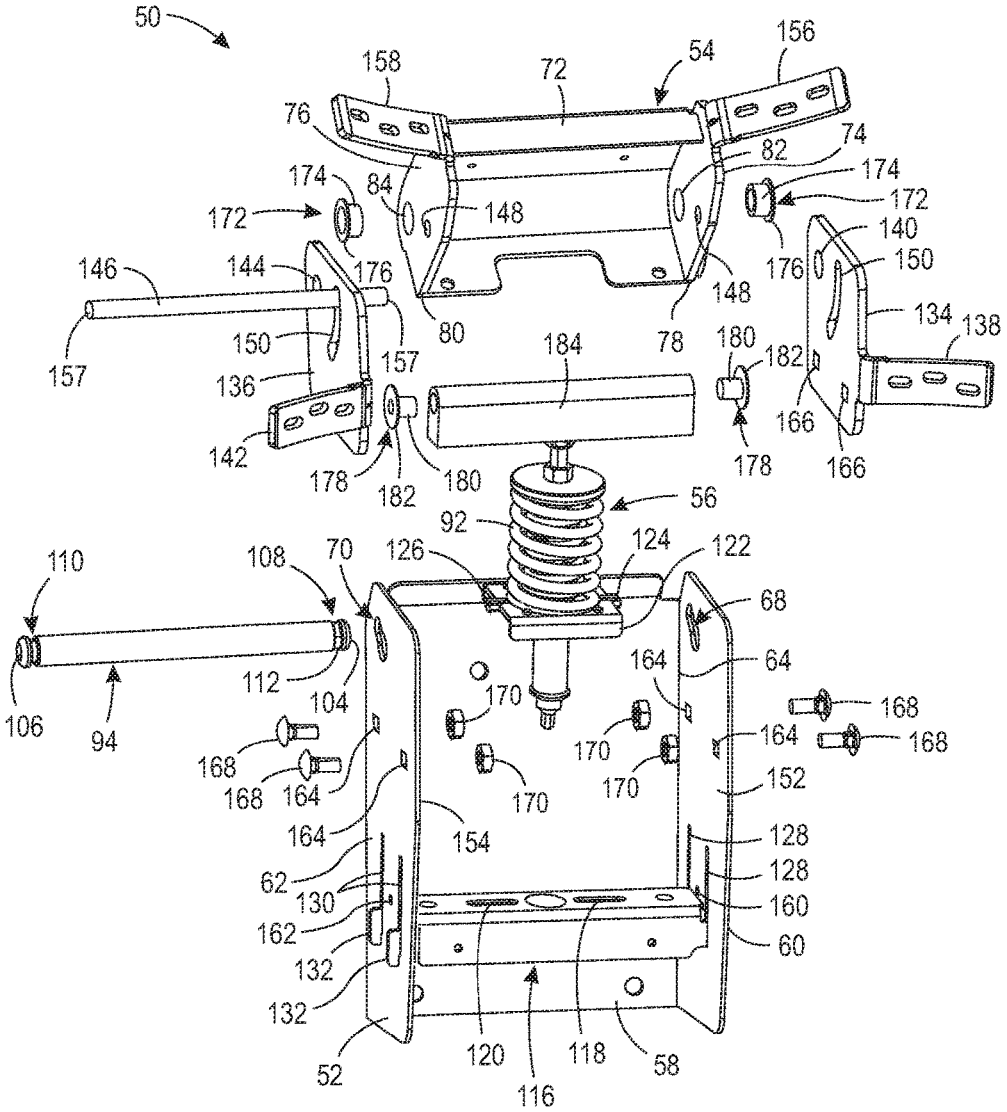
FIG. 5 is an exploded back perspective view of an embodiment of a present counterbalance assembly.
Figure 6:
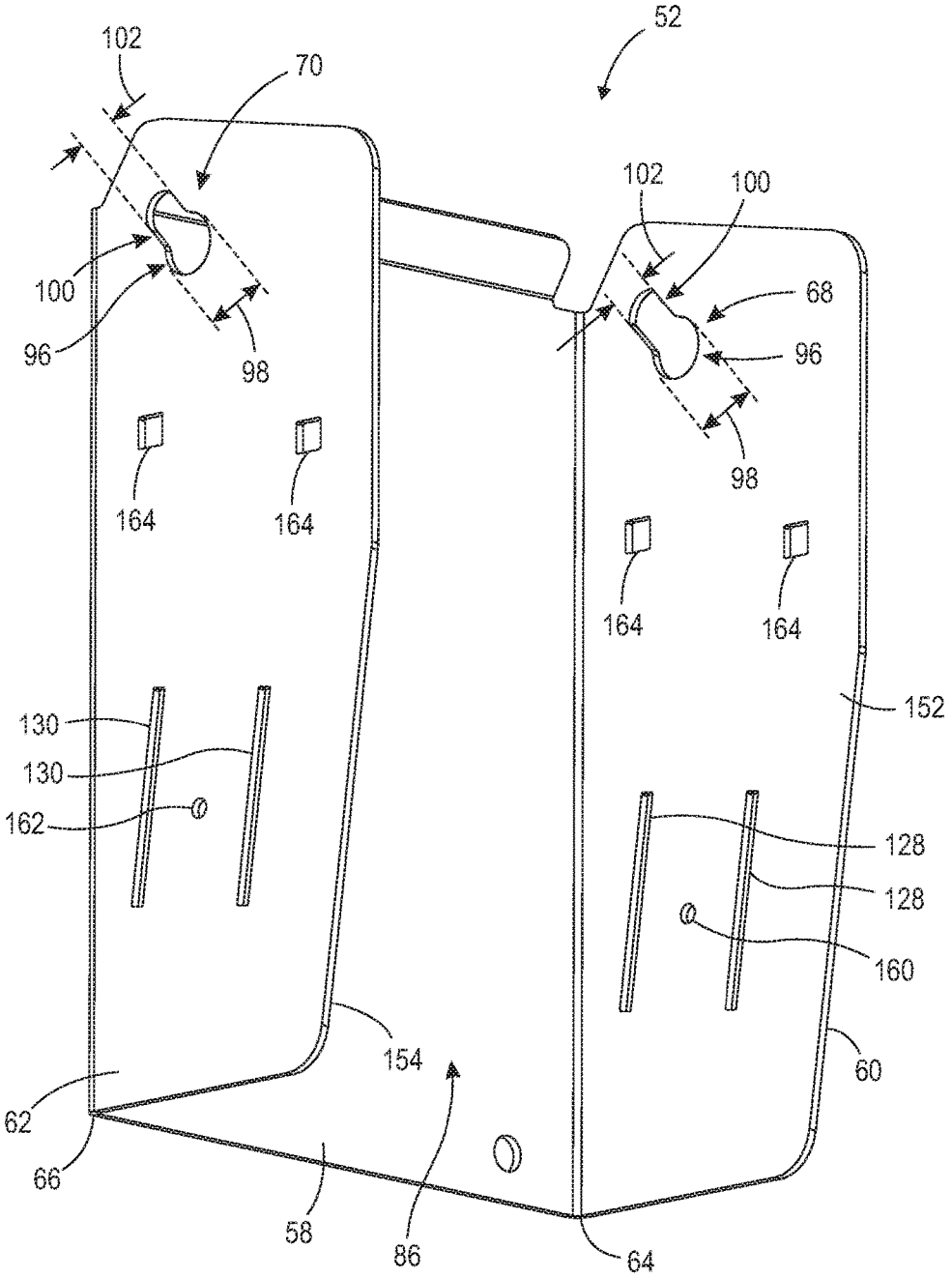
FIG. 6 is a back perspective view of an embodiment of a housing for a present counterbalance assembly.
Figure 7:
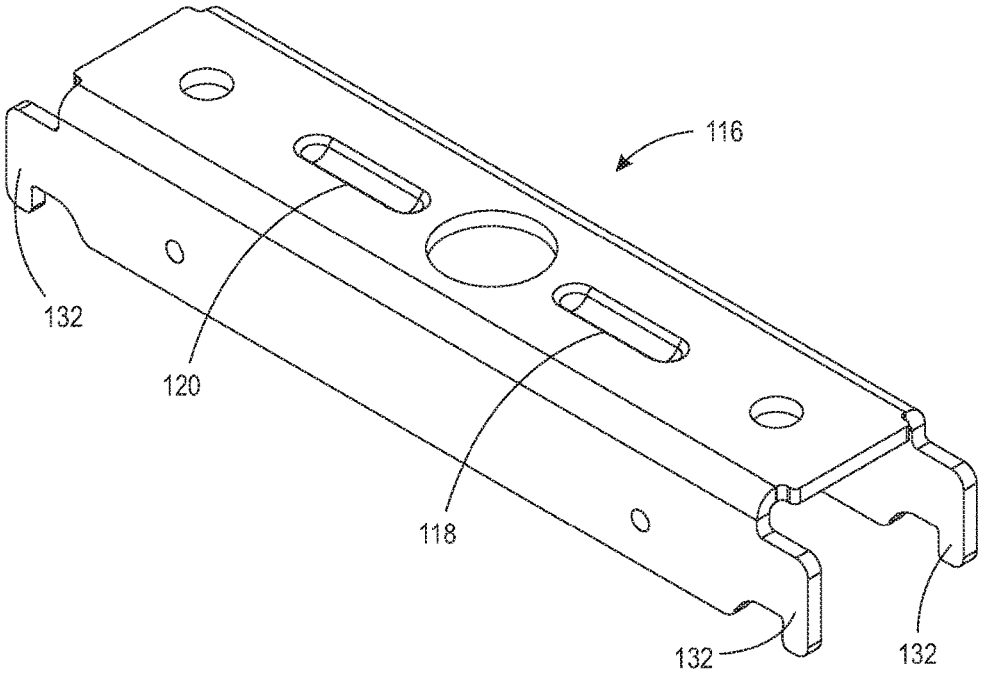
FIG. 7 is a perspective view of an embodiment of a cross bridge for a present counterbalance assembly.
Figure 8:
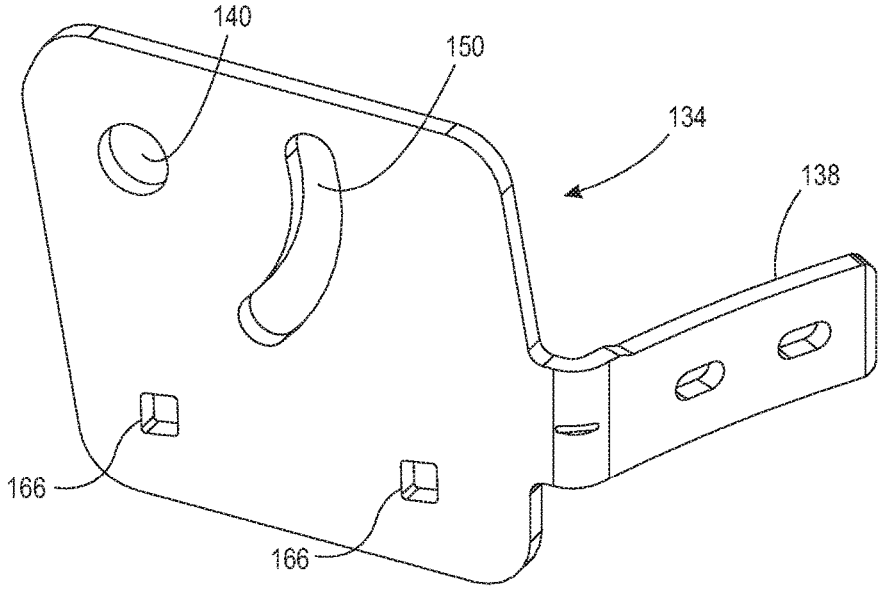
FIG. 8 is a perspective view of an embodiment of a housing mounting plate for a present counterbalance assembly.
Figure 9:
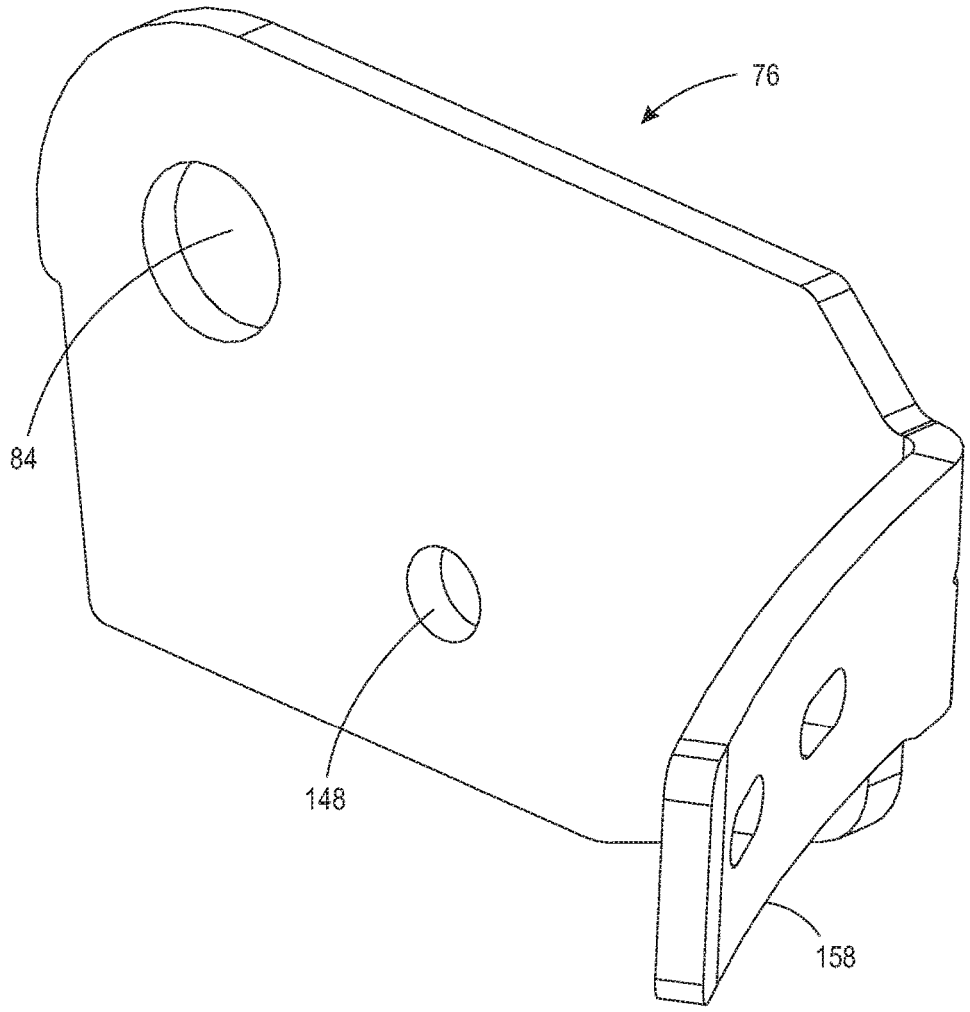
FIG. 9 is a perspective view of an embodiment of a pivot nose side wall for a present counterbalance assembly.
Figure 10:
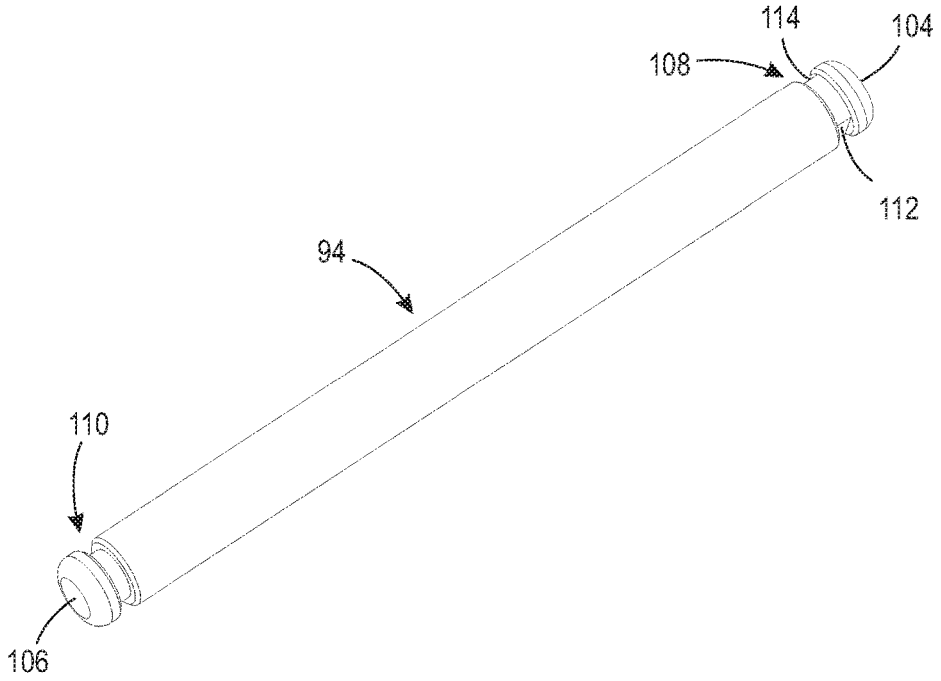
FIG. 10 is a perspective view of an embodiment of a pivot pin for a present counterbalance assembly.
Figure 11:
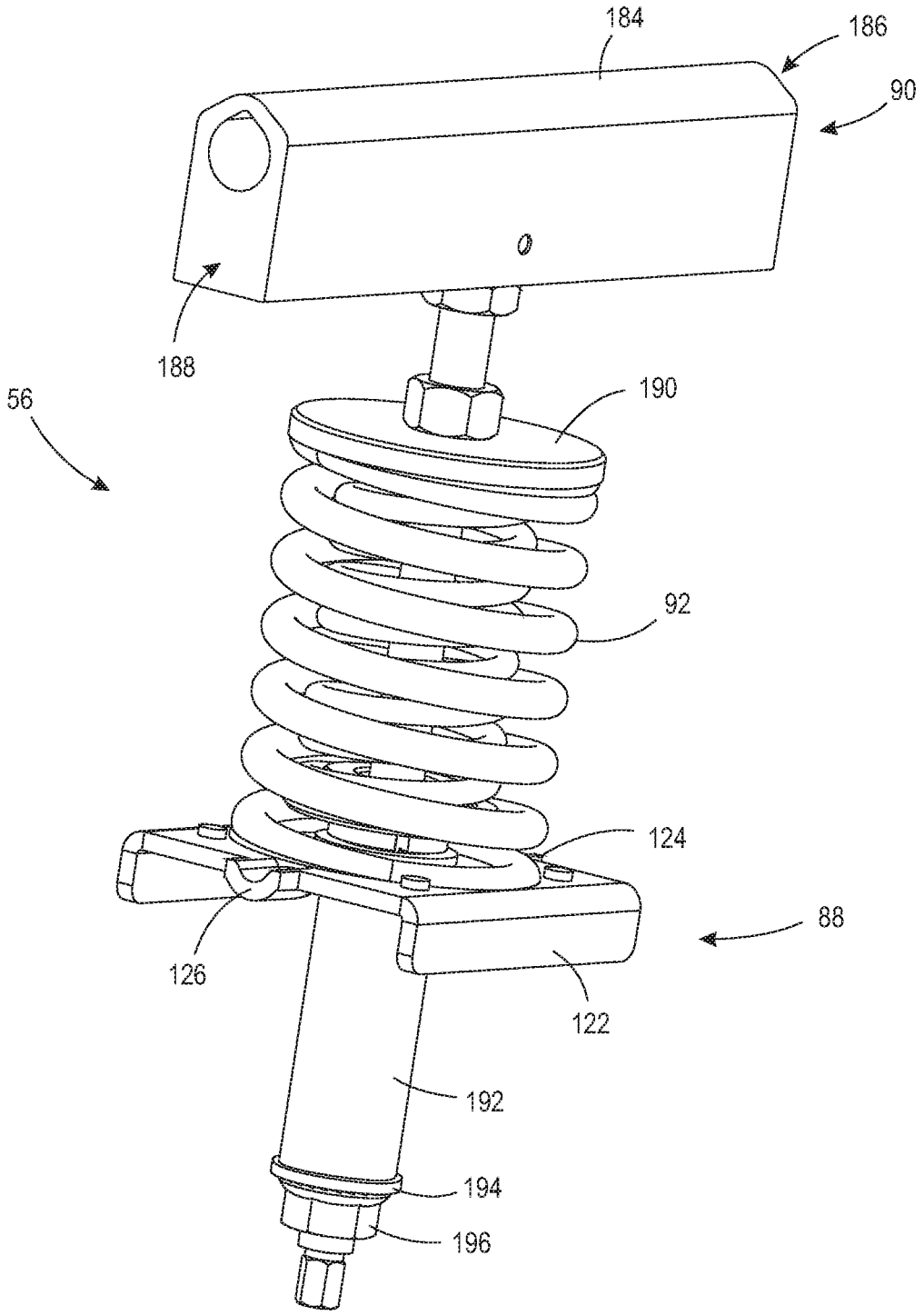
FIG. 11 is a perspective view of an embodiment of a spring pack for a present counterbalance assembly; and, FIG. 12 is a perspective view of an embodiment of a bushing for a present counterbalance assembly.
Figure 12:
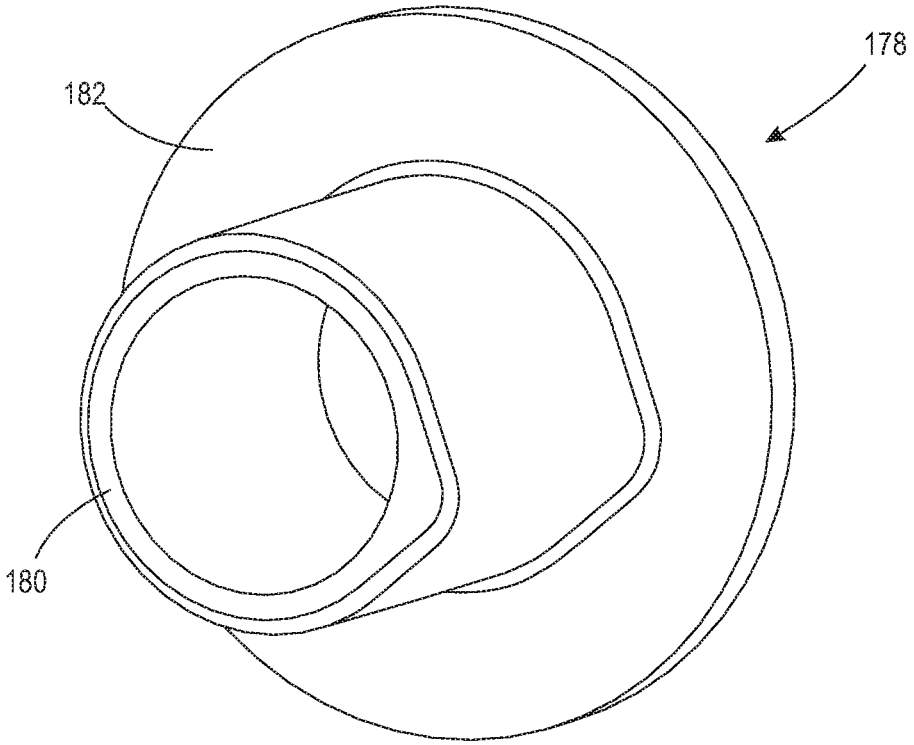

Adverting now to the figures, FIGS. 1-5 show embodiments of a present counterbalance assembly, i.e., counterbalance assembly 50. Counterbalance assembly 50 comprises housing 52, pivot nose 54 and spring pack 56. Housing 52 comprises front housing wall 58 and housing side walls 60 and 62. Front housing wall 58 comprises first housing edge 64 and second housing edge 66 opposite first housing edge 64. First housing side wall 60 projects from first housing edge 64 and comprises first retaining slot 68. Second housing side wall 62 is oppositely disposed relative to first housing side wall 60 and projects from second housing edge 66. Second housing side wall 62 comprises second retaining slot 70 in registered alignment with first retaining slot 68. Pivot nose 54 comprises front pivot nose wall 72, first pivot nose side wall 74 and second pivot side wall 76. Front pivot nose wall 72 comprises first pivot nose edge 78 and second pivot nose edge 80 opposite first pivot nose edge 78. First pivot nose side wall 74 projects from first pivot nose edge 78 and comprising first pivot nose through hole 82. Second pivot nose side wall 76 is oppositely disposed relative to first pivot nose side wall 74, projects from second pivot nose edge 80 and comprises second pivot nose through hole 84. First and second pivot nose through holes 82 and 84, respectively, are in registered alignment with first and second retaining slot 68 and 70, respectively. Spring pack 56 is disposed within volume 86 formed by housing 52 and comprises first end 88 engaged with housing 52, second end 90 engaged with pivot nose 54, and energy storage device 92 arranged between first and second ends 88 and 90, respectively. It should be appreciated that energy storage device 92 can be any known means in the art, which may include but is not limited to, a helical spring, a leaf spring, a resilient material such as a rubber, a hydraulic piston, etc.

In some embodiments, counterbalance assembly 50 further comprises pivot pin 94, each of first and second retaining slots 68 and 70, respectively, comprises first portion 96 having first width 98 and second portion 100 having second width 102 smaller than first width 98, and pivot pin 94 releasably engages second portion 100 of first and second retaining slots 68 and 70, respectively. In some embodiments, pivot pin 94 comprises first end 104 and second end 106 opposite first end 104. In those embodiments, first end 104 comprises shaped portion 108 arranged to complementarily engage second portion 100 of first retaining slot 68 and/or second end 106 comprises shaped portion 110 arranged to complementarily engage second portion 100 of second retaining slot 70. It should be appreciated that as used herein relative to the engagement of second portion 100 of first retaining slot 68 and shaped portion 108 of first end 104, and relative to the engagement of second portion 100 of second retaining slot 70 and shaped portion 110 of second end 106, "complementarily engage" may be interpreted to mean that the shaped portions fit within the second portions and/or the shaped portions fit within and non-rotatably engage the second portions. In some embodiments, shaped portion 108 of first end 104 comprises at least one flat surface, e.g., flat surfaces 112 and 114, arranged to non-rotatably and complementarily engage second portion 100 of first retaining slot 68 and/or shaped portion 110 of second end 106 comprises similar at least one flat surface (not shown) arranged to non-rotatably and complementarily engage second portion 100 of second retaining slot 70. It should be further appreciated that although at least one flat surface is disclosed, other configurations are also possible. For example, the second portions of the slots may comprise wedge shapes and the shaped portion or portions of the pivot pin may comprise a complementary wedge shape thereby preventing rotational movement between the pivot pin and the housing. Moreover, one or both of first and second ends 104 and 106, respectively, may include a shaped portion arranged to non-rotatably engage one or both of first and second retaining slots 68 and 70, respectively. Alternatively, or in addition to, the retaining slots may each have a unique size thereby requiring a particular arrangement of pivot pin 94 therein.

In some embodiments, housing 52 further comprises cross bridge 116 arranged between first and second housing side walls 60 and 62, respectively, and to engage first end 88 of spring pack 56. In some embodiments, cross bridge 116 further comprises a pair of recessed channels, i.e., recessed channels 118 and 120, and first end 88 of spring pack 56 comprises pivot plate 122 having a pair of embossed tabs, i.e., embossed tabs 124 and 126, arranged to pivotally engage the pair of recessed channels 118 and 120. In some embodiments, housing 52 further comprises a pair of parallel slots, 128 and 130 in each of first and second housing side walls 60 and 62, respectively, and cross bridge 116 comprises a plurality of tab hooks, i.e., tab hooks 132, arranged to slidingly engage the pairs of parallel slots 128 and 130 in first and second housing side walls 60 and 62, respectively. Cross bridge 116 is arranged to prevent inward movement of first and second housing side walls 60 and 62, respectively, and the plurality of tab hooks 132 are arranged to prevent outward movement of first and second housing side walls 60 and 62, respectively. It should be appreciated that cross bridge 116 may be secured within housing 52 by other means, e.g., welded in place between first and second housing side walls, and in some embodiments to housing front wall 58, and such variations fall within the spirit and scope of the claimed invention.

In some embodiments, housing 52 further comprises first housing mounting plate 134 and second housing mounting plate 136. First housing mounting plate 134 comprises first mounting tab 138 and first mounting plate through hole 140. Second housing mounting plate 136 comprises second mounting tab 142 and second mounting plate through hole 144. First and second mounting plate through holes 140 and 144, respectively, first and second pivot nose through holes 82 and 84, respectively, and first and second retaining slot 68 and 70, respectively, are in registered alignment. In some embodiments, pivot nose 54 further comprises limit pin 146. Each of first and second pivot nose side walls 74 and 76, respectively, comprises limit through hole 148, each of first and second housing mounting plates 134 and 136, respectively, further comprises arcuate slot 150. Limit pin 146 is arranged in limit through holes 148 of first and second pivot nose side walls 74 and 76, respectively, and each end 157 of limit pin 146 extends into arcuate slots 150 of first and second housing mounting plates 134 and 136, respectively. In some embodiments, second end 90 of spring pack 56 engages limit pin 146. Moreover, in some embodiments, first and second mounting plates 134 and 136, respectively, are fixedly secured to inner surfaces 152 and 154 of first and second housing side walls 60 and 62, respectively. It should be appreciated in view of the foregoing arrangements, in some embodiments, limit pin 146 is fully captured within counterbalance assembly 50. In other terms, limit pin 146 passes through each limit through hole 148 and arcuate slot 150; however, limit pin 146 is captured within housing 52 by inner surfaces 152 and 154. Thus, as counterbalance assembly 50 is actuated from a closed to open position, and from an open to a closed position, users of assembly 50 are protected from potential injury from the moving limit pin 146 within arcuate slots 150.

In some embodiments, each of pivot nose side walls 74 and 76 comprises a mounting tab, e.g., mounting tabs 156 and 158, respectively. Various other aspects of the present counterbalance assembly are now described to enable one to appreciate some of the other features and benefits of the present arrangements. For example, in some embodiments, housing 52 comprises holes 160 and 162 disposed in first and second housing walls 60 and 62, respectively. After assembling counterbalance 50, but prior to installing counterbalance 50 on a subsequent device, e.g., a ceramic grill, a screw or other retaining means can be installed within holes 160 and 162 thereby preventing any upward movement of cross bridge 116. Moreover, housing 52 may include holes 164 in first and second housing walls 60 and 62, respectively, arranged to assist with securing first and second housing mounting plates 134 and 136, respectively, via through holes 166 within the same. As depicted in the figures, bolts 168 may be secured within each of holes 164 and 166 via nuts 170, thereby securing the housing mounting plates to the housing. However, it should be appreciated that any means of securing the housing mounting plates within the housing may be used.

In some embodiments, frictional wear between metal parts may be minimized or prevented via inclusion of bushings. For example, bushings 172 comprising body 174 and flange 176 may be included between pivot nose side walls 74 and 76 and housing mounting plates 134 and 136. Body portion 174 is installed within pivot nose through holes 82 and 84, while flange 176 prevents direct metal-to-metal contact between the pivot nose side walls and housing mounting plates. Similarly, bushings 178 comprising shaped body 180 and flange 182 may be included between pivot nose side walls 74 and 76 and connector 184. Openings 186 and 188 of connector 184 may be shaped to complementarily engage shaped body 180. Body portion 180 is installed within openings 186 and 188, while flange 182 prevents direct metal-to-metal contact between the pivot nose side walls and the connector.

In some embodiments, spring pack 56 comprises spring retainer 190, spacer 192, washer 194 and nut 196. The torque provided by counterbalance assembly 50 may be adjusted by changing the position of spring retainer 190. Spacer 192, washer 194 and nut 196 are used to retain energy storage device 92 in a compressed position until after counterbalance assembly 50 is secured to a subsequent device, e.g., a ceramic smoker/grill. It should be appreciated that, in the embodiments depicted in the figures, forces are transmitted from housing 52 to cross bridge 116, to pivot plate 122, to energy storage device 92, to connector 184, to limit pin 146 and finally to pivot nose side walls 74 and 76, while arcuate slots 150 limit the range of travel of the assembly.

In some embodiments, the present disclosure includes a method of assembling a counterbalance, e.g., counterbalance 50. The method comprises: aligning first and second pivot through holes 82 and 84, respectively, with first portions 96 of first and second retaining slots 68 and 70, respectively; positioning pivot pin 94 within first and second pivot through holes 82 and 84, respectively, with first portions 96 of first and second retaining slots 68 and 70, respectively; and, shifting pivot pin 94 from first portions 96 of first and second retaining slots 68 and 70, respectively, to second portions 100 of first and second retaining slots 68 and 70, respectively.

In some embodiments, prior to the step of aligning first and second pivot through holes 82 and 84, respectively, with first portions 96 of first and second retaining slots 68 and 70, respectively, the present method further comprises: aligning second end 90 of spring pack 56 with through holes 148 in first and second pivot nose side walls 74 and 76, respectively, and first and second arcuate slots 150, respectively; and, positioning limit pin 146 within second end 90 of spring pack 56, through holes 148 in first and second pivot nose side walls 74 and 76, respectively, and first and second arcuate slots 150, respectively. In some embodiments, after the step of shifting pivot pin 94, further comprises: fixedly securing first and second housing mounting plates 134 and 136, respectively, to first and second housing side walls 60 and 62, respectively.

In some embodiments, the present method further comprises: engaging first end 88 of spring pack 56 with cross bridge 116.

In some embodiments, the present disclosure includes a method of assembling a counterbalance, e.g., counterbalance 50. The method comprises: aligning second end 90 of spring pack 56 with through holes 148 in first and second pivot nose side walls 74 and 76, respectively, and first and second arcuate slots 150; and, positioning limit pin 146 within second end 90 of spring pack 56, limit through holes 148, respectively, in first and second pivot nose side walls 74 and 76, respectively, and first and second arcuate slots 150.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claim is:

1. A counterbalance assembly comprising:

a housing comprising:

a front housing wall comprising a first housing edge and a second housing edge opposite the first housing edge;

a first housing side wall projecting from the first housing edge and comprising a first retaining slot; and, a second housing side wall oppositely disposed relative to the first housing side wall, projecting from the second housing edge and comprising second retaining slot in registered alignment with the first retaining slot;

a pivot nose comprising:

a front pivot nose wall comprising a first pivot nose edge and a second pivot nose edge opposite the first pivot nose edge;

a first pivot nose side wall projecting from the first pivot nose edge and comprising a first pivot nose through hole; and, a second pivot nose side wall oppositely disposed relative to the first pivot nose side wall, projecting from the second pivot nose edge and comprising a second pivot nose through hole, the first and second pivot nose through holes are in registered alignment with the first and second retaining slots;

a spring pack disposed within a volume formed by the housing and comprising:

a first end engaged with the housing;

a second end engaged with the pivot nose; and, an energy storage device arranged between the first and second ends; and, a pivot pin connecting the housing and the pivot nose for relative pivoting therebetween, wherein each of the first and second retaining slots comprises a first portion having a first width and a second portion having a second width smaller than the first width, and the pivot pin releasably engages the second portion of the first and second retaining slots.

2. The counterbalance assembly of claim 1 wherein the pivot pin comprises a first end and a second end opposite the first end, and the first end comprises a shaped portion arranged to complementarily engage the second portion of the first retaining slot and/or the second end comprises a shaped portion arranged to complementarily engage the second portion of the second retaining slot.

3. The counterbalance assembly of claim 2 wherein the shaped portion of the first end comprises at least one flat surface arranged to non-rotatably and complementarily engage the second portion of the first retaining slot and/or the shaped portion of the second end comprises at least one flat surface arranged to non-rotatably and complementarily engage the second portion of the second retaining slot.

4. The counterbalance assembly of claim 1 wherein the housing further comprises:

a cross bridge arranged between the first and second housing side walls and to engage the first end of the spring pack.

5. The counterbalance assembly of claim 4 wherein the cross bridge further comprises a pair of recessed channels and the first end of the spring pack comprises a pivot plate having a pair of embossed tabs arranged to pivotally engage the pair of recessed channels.

6. The counterbalance assembly of claim 4 wherein the housing further comprises a pair of parallel slots in each of the first and second housing side walls and the cross bridge comprises a plurality of tab hooks arranged to slidingly engage the pairs of parallel slots in the first and second housing side walls, wherein the cross bridge is arranged to prevent inward movement of the first and second housing side walls and the plurality of tab hooks are arranged to prevent outward movement of the first and second housing side walls.

7. The counterbalance assembly of claim 1 wherein the housing further comprises:

a first housing mounting plate comprising a first mounting tab and a first mounting plate through hole; and, a second housing mounting plate comprising a second mounting tab and a second mounting plate through hole, wherein the first and second mounting plate through holes, the first and second pivot nose through holes and the first and second retaining slots are in registered alignment.

8. The counterbalance assembly of claim 7 wherein the pivot nose further comprises a limit pin, each of the first and second pivot nose side walls comprises a limit through hole, each of the first and second housing mounting plates further comprises an arcuate slot, and the limit pin is arranged in the limit through holes of the first and second pivot nose side walls and each end of the limit pin extends into the arcuate slots of the first and second housing mounting plates.

9. The counterbalance assembly of claim 8 wherein the second end of the spring pack engages the limit pin.

10. The counterbalance assembly of claim 7 wherein the first and second mounting plates are fixedly secured to inner surfaces of the first and second housing side walls, respectively.

11. The counterbalance assembly of claim 1 wherein each of the pivot nose side walls comprises a mounting tab.

12. A method of assembling a counterbalance comprising a housing, a pivot nose, a pivot pin and a spring pack, the housing comprising a front housing wall comprising a first housing edge and a second housing edge opposite the first housing edge, a first housing side wall projecting from the first housing edge and comprising a first retaining slot, and a second housing side wall oppositely disposed relative to the first housing side wall, projecting from the second housing edge and comprising second retaining slot in registered alignment with the first retaining slot, each of the first and second retaining slots comprises a first portion having a first width and a second portion having a second width smaller than the first width, the pivot nose comprising a front pivot nose wall comprising a first pivot nose edge and a second pivot nose edge opposite the first pivot nose edge, a first pivot nose side wall projecting from the first pivot nose edge and comprising a first pivot through hole, and a second pivot nose side wall oppositely disposed relative to the first pivot nose side wall, projecting from the second pivot nose edge and comprising a second pivot nose through hole, the first and second pivot nose through holes are in registered alignment, and the spring pack comprises a first end engaged with the housing, a second end engaged with the pivot nose, and an energy storage device arranged between the first and second ends, the method comprising:

aligning the first and second pivot through holes with the first portions of the first and second retaining slots, respectively;

positioning the pivot pin within the first and second pivot through holes with the first portions of the first and second retaining slots; and, shifting the pivot pin from the first portions of the first and second retaining slots to the second portions of the first and second retaining slots.

13. The method of assembling a counterbalance of claim 12 wherein the pivot pin comprises a first end and a second end opposite the first end, and the first end comprises a shaped portion arranged to complementarily engage the second portion of the first retaining slot and/or the second end comprises a shaped portion arranged to complementarily engage the second portion of the second retaining slot.

14. The method of assembling a counterbalance of claim 13 wherein the shaped portion of the first end comprises at least one flat surface arranged to non-rotatably and complementarily engage the second portion of the first retaining slot and/or the shaped portion of the second end comprises at least one flat surface arranged to non-rotatably and complementarily engage the second portion of the second retaining slot.

15. The method of assembling a counterbalance of claim 12 wherein the counterbalance further comprises a limit pin, the housing further comprises a first housing mounting plate comprising a first mounting tab, a first arcuate slot and a first mounting plate through hole and a second housing mounting plate comprising a second mounting tab, a second arcuate slot and a second mounting plate through hole, each of the first and second pivot nose side walls comprises a through hole, prior to the step of aligning the first and second pivot through holes with the first portions of the first and second retaining slots, respectively, the method further comprising:

aligning the second end of the spring pack with the through holes in the first and second pivot nose side walls and first and second arcuate slots; and, positioning the limit pin within the second end of the spring pack, the through holes in the first and second pivot nose side walls and first and second arcuate slots.

16. The method of assembling a counterbalance of claim 15, after the step of shifting the pivot pin, further comprises:

fixedly securing the first and second housing mounting plates to the first and second housing side walls, respectively.

17. The method of assembling a counterbalance of claim 12 wherein the housing further comprises a cross bridge arranged between the first and second housing side walls, the method further comprising:

engaging the first end of the spring pack with the cross bridge.

18. The method of assembling a counterbalance of claim 17 wherein the cross bridge further comprises a pair of recessed channels and the first end of the spring pack comprises a pivot plate having a pair of embossed tabs arranged to pivotally engage the pair of recessed channels.

19. The method of assembling a counterbalance of claim 17 wherein the housing further comprises a pair of parallel slots in each of the first and second housing side walls and the cross bridge comprises a plurality of tab hooks arranged to slidingly engage the pairs of parallel slots in the first and second housing side walls, wherein the cross bridge is arranged to prevent inward movement of the first and second housing side walls and the plurality of tab hooks are arranged to prevent outward movement of the first and second housing side walls.

20. A method of assembling a counterbalance comprising a housing, a first housing mounting plate, a second housing mounting plate, a pivot nose, a pivot pin, a limit pin and a spring pack, the housing comprising a front housing wall comprising a first housing edge and a second housing edge opposite the first housing edge, a first housing side wall projecting from the first housing edge, and a second housing side wall oppositely disposed relative to the first housing side wall, projecting from the second housing edge, the first housing mounting plate comprising a first mounting tab, a first arcuate slot and a first mounting plate through hole, the second housing mounting plate comprising a second mounting tab, a second arcuate slot and a second mounting plate through hole, the pivot nose comprising a front pivot nose wall comprising a first pivot nose edge and a second pivot nose edge opposite the first pivot nose edge, a first pivot nose side wall projecting from the first pivot nose edge and comprising a first pivot through hole and a first limit through hole, and a second pivot nose side wall oppositely disposed relative to the first pivot nose side wall, projecting from the second pivot nose edge and comprising a second pivot nose through hole and a second limit through hole, the first and second pivot nose through holes are in registered alignment, and the spring pack comprises a first end engaged with the housing, a second end engaged with the pivot nose, and an energy storage device arranged between the first and second ends, the method comprising:

aligning the second end of the spring pack with the first and second limit through holes and first and second arcuate slots; and, positioning the limit pin within the second end of the spring pack, the first and second limit through holes and the first and second arcuate slots.

* * * * *